US008075212B2

(12) United States Patent
Kato

(10) Patent No.: US 8,075,212 B2
(45) Date of Patent: Dec. 13, 2011

(54) TAPE PRINTING APPARATUS

(75) Inventor: Nobuo Kato, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 474 days.

(21) Appl. No.: 12/380,071

(22) Filed: Feb. 23, 2009

(65) Prior Publication Data

US 2009/0220292 A1 Sep. 3, 2009

(30) Foreign Application Priority Data

Feb. 29, 2008 (JP) ..... 2008-050031

(51) Int. Cl.
*B41J 11/70* (2006.01)

(52) U.S. Cl. ..... 400/621; 400/693

(58) Field of Classification Search ..... 400/621, 400/693

See application file for complete search history.

(56) References Cited

U.S. PATENT DOCUMENTS

| | | | |
|---|---|---|---|
| 5,441,352 | A | 8/1995 | Shiota |
| 5,839,840 | A | 11/1998 | Kawano |
| 6,602,009 | B2 | 8/2003 | Sodeyama |
| 7,067,735 | B2 | 6/2006 | Murata |

FOREIGN PATENT DOCUMENTS

| | | | |
|---|---|---|---|
| EP | 0775585 | A1 | 5/1997 |
| EP | 0832753 | A1 | 4/1998 |
| EP | 1769929 | A2 | 4/2007 |
| JP | 2-092565 | | 4/1990 |
| JP | 7089159 | | 4/1995 |
| JP | 7-195297 | | 8/1995 |
| JP | 9-207094 | | 8/1997 |
| JP | 10100494 | | 4/1998 |
| JP | 2002-137496 | | 5/2002 |
| JP | 2002-137496 | A | 5/2002 |
| JP | 2002346970 | | 12/2002 |
| JP | 2005067211 | | 3/2005 |
| JP | 2005088239 | | 4/2005 |

*Primary Examiner* — Seung Lee
*Assistant Examiner* — Christopher Stanford
(74) *Attorney, Agent, or Firm* — Day Pitney LLP

(57) ABSTRACT

In the tape printing apparatus 1, in the state that the back cover 11 is not attached to the apparatus body 2, the coil spring member 22 urges the stopper member 15 so as to rotate and the cutter lever 5 becomes inoperable based on that the engagement portion 15A of the stopper member 15 is engaged with the difference portion 19 of the cutter lever 5, and in the state that the back cover 11 is attached to the apparatus body 2, the stopper member 5 is rotated against the urging force of the coil spring member 22 based on that the engagement lib 14 of the back cover 11 is engaged with the engagement portion 15B of the stopper member 15 and the cutter lever 5 becomes operable based on that the engagement portion 15A of the stopper member 15 is released from the difference portion 19 of the cutter lever 5.

4 Claims, 15 Drawing Sheets

TAPE PRINTING APPARATUS

CROSS-REFERENCE TO RELATED APPLICATIONS

This application claims priority from JP 2008-050031, filed Feb. 29, 2008, the contents of which are hereby incorporated by reference.

TECHNICAL FIELD

The present invention relates to a tape printing apparatus with a manual operative cutter including a cutter lever. In particular, the present invention relates to a tape printing apparatus having a tape printing apparatus body and a cover member attachable to and removable from the tape printing apparatus body, in the tape printing apparatus, a cutter lever does not operable when the cover member is removed from the tape printing apparatus body and becomes operable when the cover member is attached to the tape printing apparatus body.

BACKGROUND

Conventionally, there is provided various tape printing apparatuses in each of which a scissors-like cutter is operated by manually operating a cutter lever and a tape on which characters are printed by a printing head is cut.

For example, in Japanese Publication No. Hei 10-100494, it is disclosed a tape printing apparatus in which a platen holder retaining a platen roller is rotatably supported at one side of the tape printing apparatus and a cutter lever is rotatably supported at a position adjacent to the platen holder. In the tape printing apparatus, when printing is conducted, the platen holder is rotated toward a thermal head and characters are printed on the tape while the platen roller is contacted with the thermal head through the tape derived from a tape cassette.

In the above tape printing apparatus, when the tape on which characters are printed according to the above is cut, the cutter lever is rotated toward a holder member having a cutter blade and the holder member is pressed by a press member, thereby the tape is cut by the cutter blade. And when printing is not conducted, the platen holder is rotated toward a direction according to which the platen holder is separated from the thermal head, thereby a stopper portion of the platen holder is contacted with an end portion of the cutter lever. Thus, the cutter lever is made inoperable.

Further, as disclosed in Japanese Publication No. 2005-88239, it is proposed a tape forming apparatus which has the same construction as the above mentioned tape printing apparatus. In this tape forming apparatus, the cutter lever is rotatably arranged at one side of the main body and the platen holder rotatably supporting the platen is rotatably arranged at the other side of the main body.

In the tape printing apparatus disclosed in Japanese Publication No. Hei 10-100494, when printing is not conducted on the tape, the stopper portion of the platen holder is contacted with the end portion of the cutter lever, thereby the cutter lever is locked in the inoperable state. However, the platen holder and the cutter lever is arranged at the same side in the tape printing apparatus. In this case, one side of the tape printing apparatus is inevitably and largely protruded outward, therefore a balance of both sided in the tape printing apparatus is broken. In a case that one side of the tape printing apparatus is protruded, it become difficult for a user to grasp and support the tape printing apparatus by one of hands even if such tape printing apparatus is handy type one.

On the other hand, in a case of the tape forming apparatus disclosed in Japanese Publication No. 2005-88239, the cutter lever is rotatably arranged at one side of the main body and the platen holder rotatably supporting the platen is rotatably arranged at the other side of the main body. Thereby, there is no problem that one side of the tape printing apparatus is protruded and the tape printing apparatus can be constructed so as to have a balanced shape at both sides thereof.

However, as in the tape forming apparatus, in a case that the cutter lever and the platen holder are separately arranged at the both sides of the tape forming apparatus, it is very difficult to arrange a lock mechanism to make the cutter lever inoperable in the non-printing state between the cutter lever and the platen holder. Based on this situation, it is not provided in the tape forming apparatus disclosed in Japanese Publication No. 2005-88239 the lock mechanism to make the cutter lever inoperable.

In order to dissolve the above problem, the present invention has been done and has an object to provide a tape printing apparatus in which a cutter lever does not operable when the cover member is removed from the tape printing apparatus body and becomes operable when the cover member is attached to the tape printing apparatus body, thereby the cutter lever can be changed between an inoperable state and an operable state by a simple construction even if the cutter lever and the platen holder are separately arranged at the both sides of the tape printing apparatus.

SUMMARY

In order to accomplish the above objects, according to one aspect of the present invention, it is provided a tape printing apparatus comprising:

a tape printing apparatus body;

a cassette installation portion provided in the tape printing apparatus body, in the cassette installation portion a tape cassette being installed;

a print head for printing characters on a tape derived from the tape cassette;

a tape discharge portion for discharging the tape on which characters are printed through the print head;

a cutter constructed in a scissors-like shape from a fixed blade and a movable blade, the cutter being provided within the tape printing apparatus body adjacent to the tape discharge portion;

a cutter lever for driving the movable blade of the cutter, the cutter lever being rotatably arranged in the tape printing apparatus body;

a drive mechanism for transmitting rotation of the cutter lever to the movable blade, the drive mechanism being arranged between the cutter lever and the movable blade;

a cover member arranged so as to be openable and closeable for the tape printing apparatus body;

the tape printing apparatus further comprising:

a first engagement portion formed on a back surface of the cover member;

a difference portion formed in the cutter lever;

a stopper member formed in a plate-like shape, the stopper member including a second engagement portion which is rotatably formed parallel to a wall surface of the tape cassette and is engaged with the difference portion of the cutter lever, a third engagement portion engaging with the first engagement portion and a spring support portion; and a spring member supported to the spring support portion, the spring member urging the stopper member so as to rotate;

wherein when the tape printing apparatus body is not covered by the cover member, the spring member urges the stopper member so as to rotate and the second engagement portion of the stopper member is engaged with the difference portion of the cutter lever, thereby the cutter lever becomes inoperable, and wherein when the tape printing apparatus body is covered by the cover member, the stopper member is rotated against rotational urging force of the spring member based on that the first engagement portion of the cover member is engaged with the third engagement portion of the stopper member and the second engagement portion of the stopper member is released from the difference portion of the cutter lever, thereby the cutter lever becomes operable.

According to the tape printing apparatus mentioned in the above, when the tape printing apparatus body is not covered by the cover member, the spring member urges the stopper member so as to rotate and the second engagement portion of the stopper member is engaged with the difference portion of the cutter lever, thereby the cutter lever becomes inoperable, and when the tape printing apparatus body is covered by the cover member, the stopper member is rotated against rotational urging force of the spring member based on that the first engagement portion of the cover member is engaged with the third engagement portion of the stopper member and the second engagement portion of the stopper member is released from the difference portion of the cutter lever, thereby the cutter lever becomes operable. Therefore, even if the cutter lever and the platen holder are separately arranged at each of both sides of the tape printing apparatus, the cutter lever can be changed in one of the operable state and inoperable state, based on a simple construction.

And since the stopper member formed in the plate-like shape is arranged parallel to the wall surface of the tape cassette installed in the cassette installation portion, the stopper member can be arranged for the cutter lever without enlarging the lateral width of the tape printing apparatus.

BRIEF DESCRIPTION OF THE DRAWINGS

The accompany drawings, which are incorporated in and constitute a part of this specification illustrate embodiments of the invention and, together with the description, serve to explain the objects, advantages and principle of the invention.

In the drawings.

DETAILED DESCRIPTION

Hereinafter, the tape printing apparatus according to the present invention will be explained in detail with reference to the drawings, based on an embodiment embodying the present invention.

Figure 1:
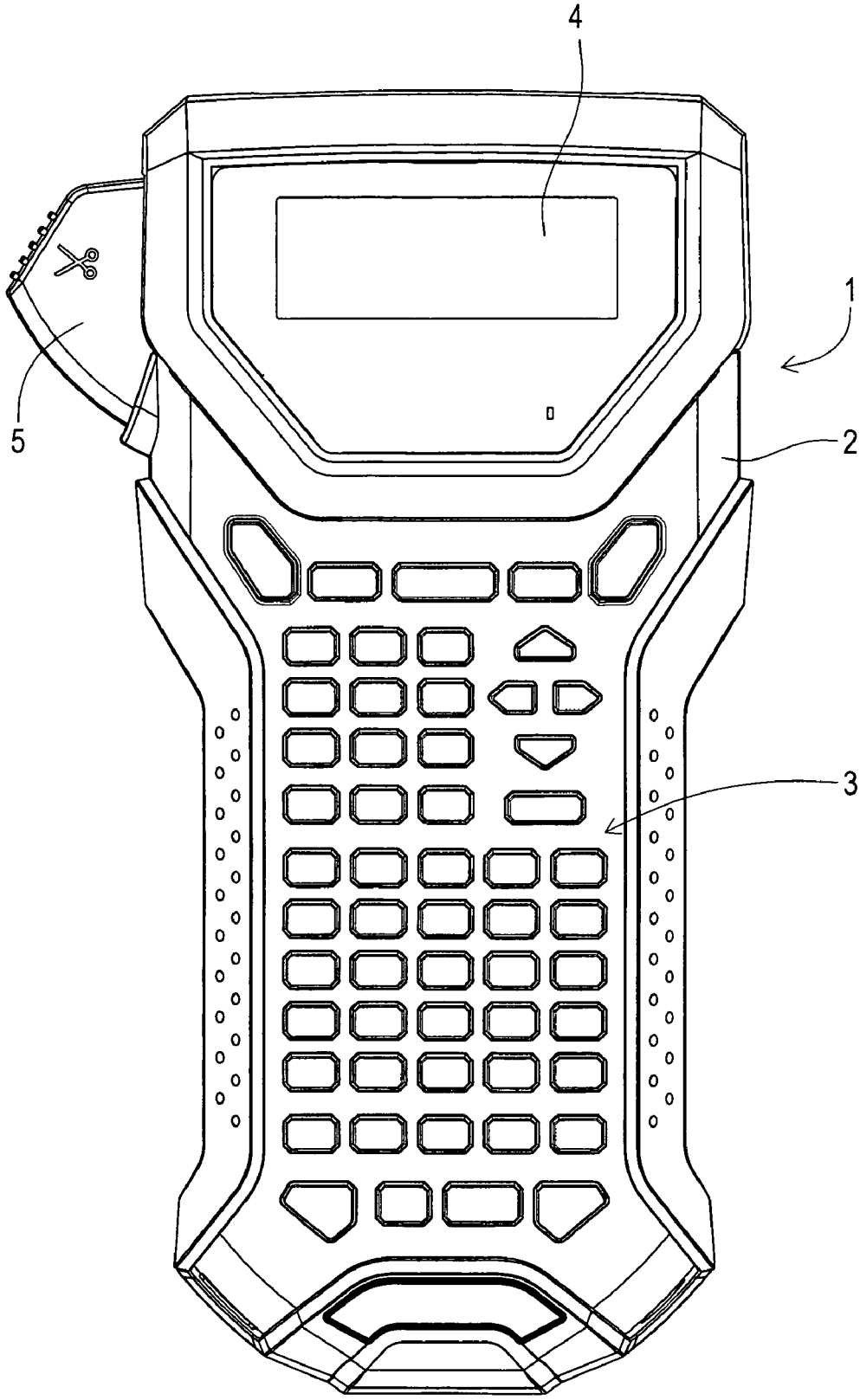
FIG. 1 is a plan view of the tape printing apparatus.
Figure 3:
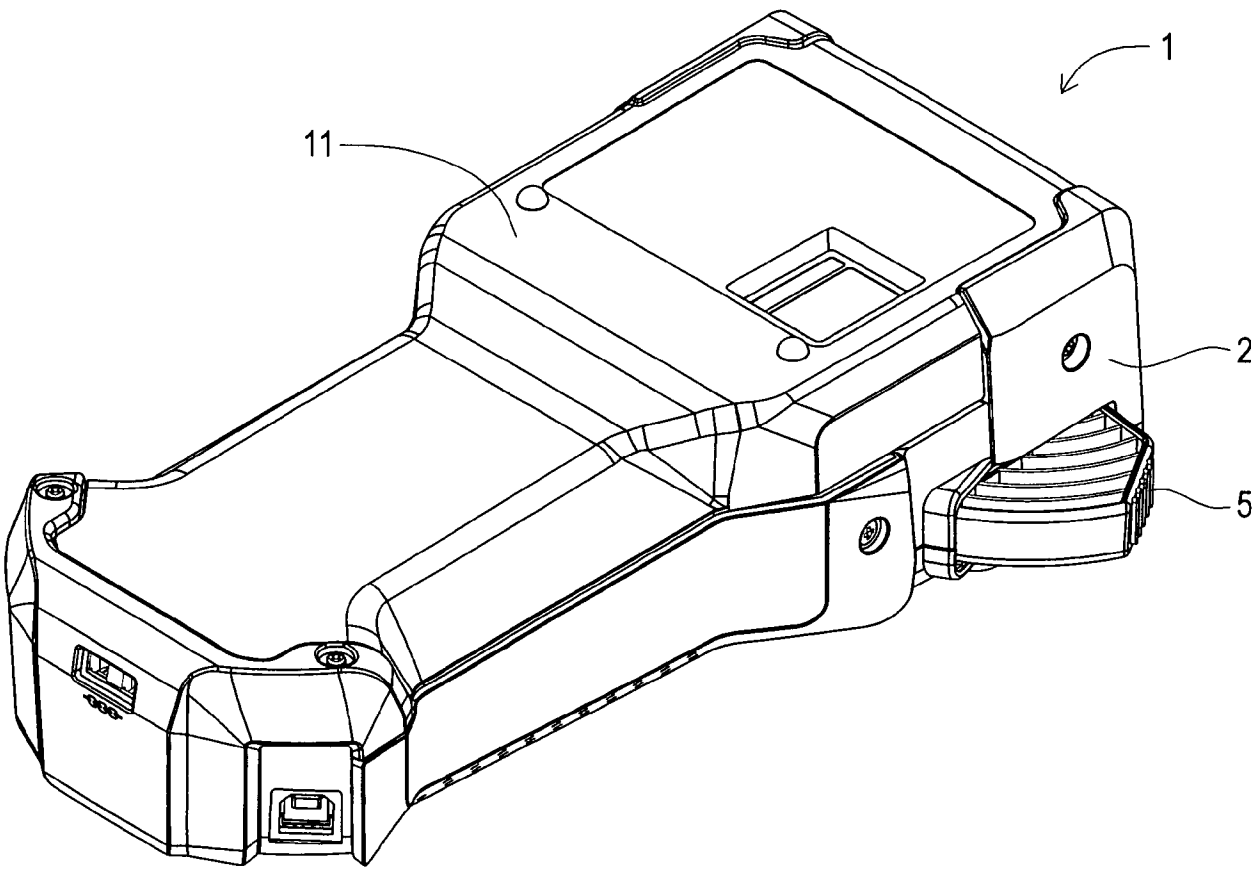
FIG. 3 is a back perspective view of the tape printing apparatus.
Figure 4:
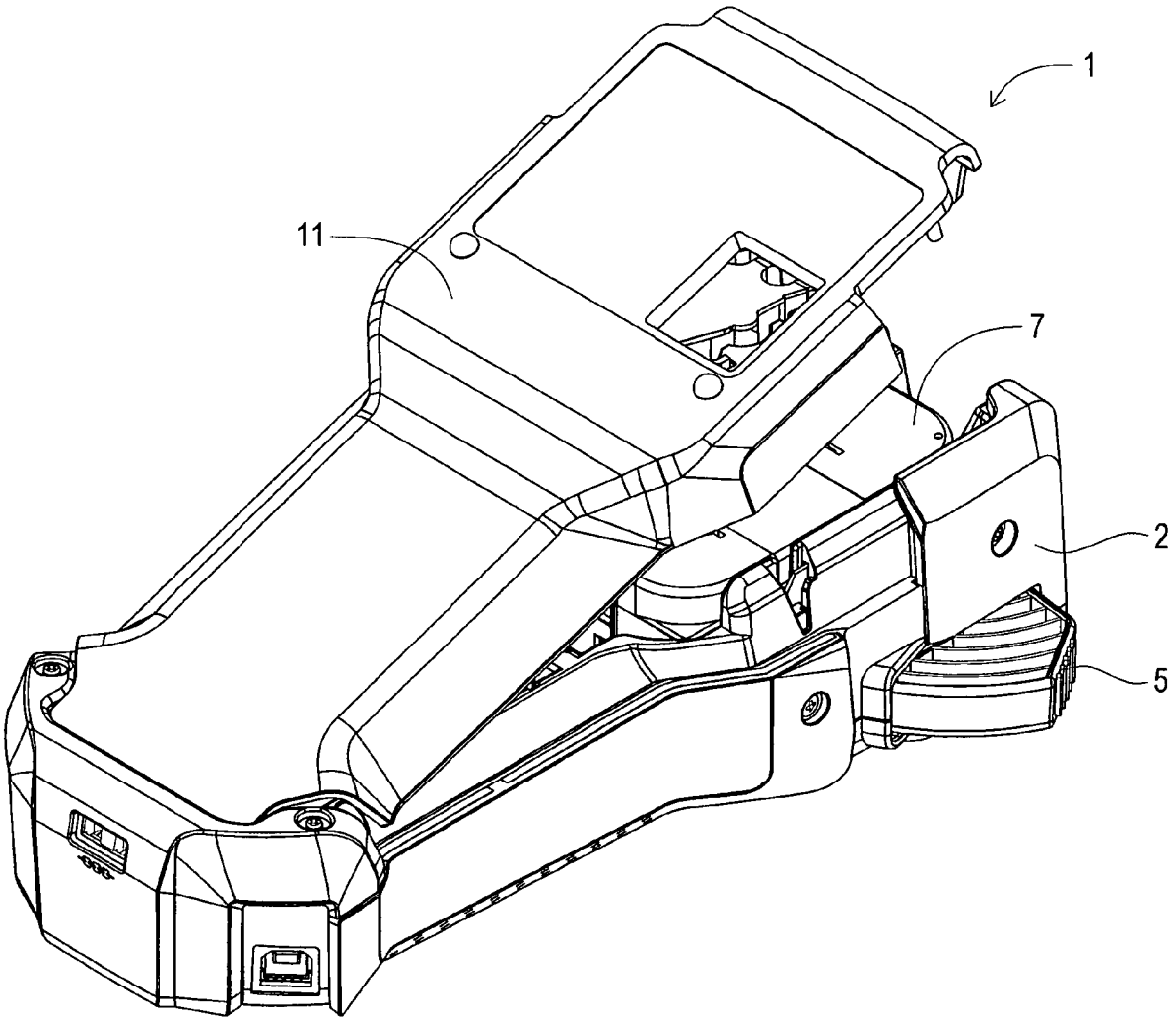
FIG. 4 is a back perspective view of the tape printing apparatus showing a state that removing of the back cover is started.
Figure 5:
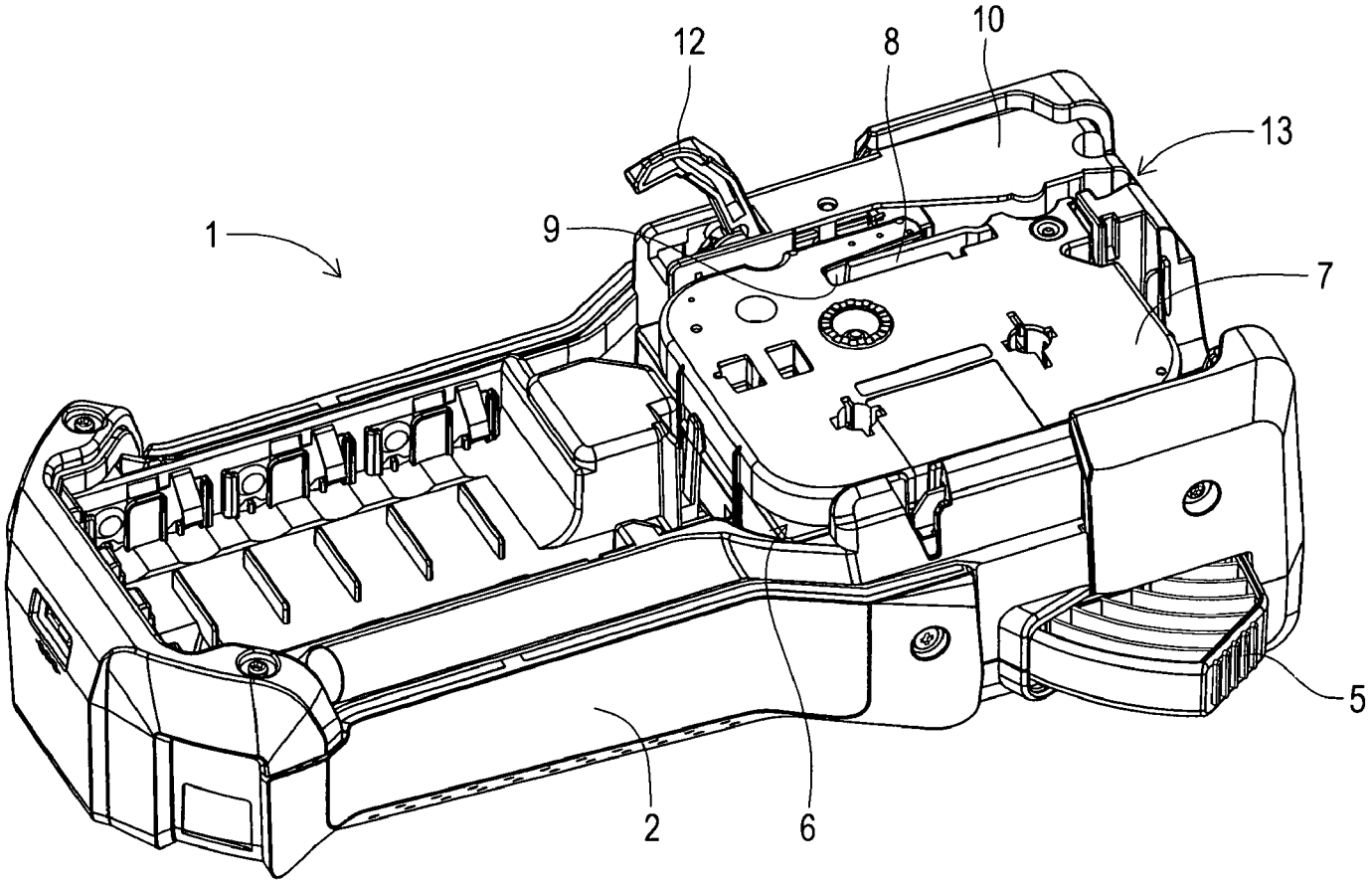
FIG. 5 is a back perspective view in a state that the back cover is removed.
Figure 6:
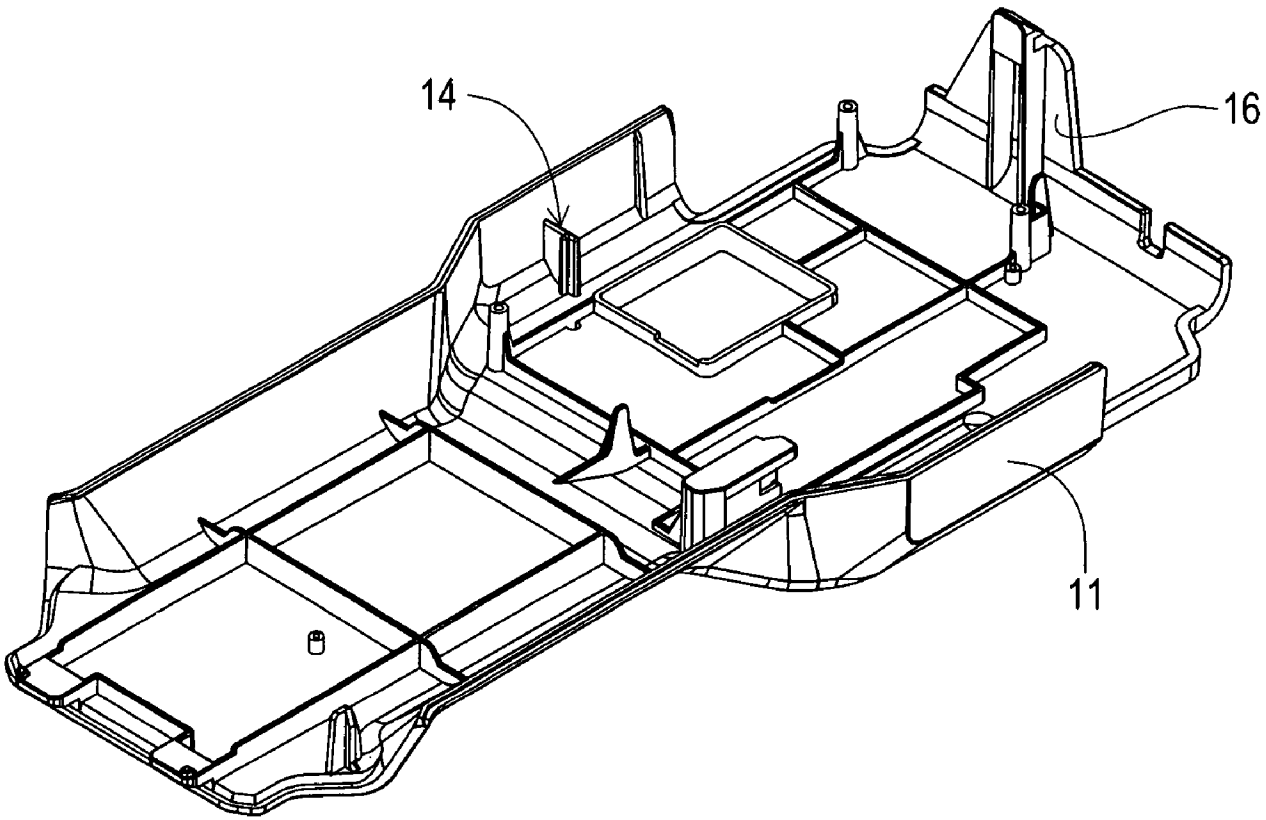
FIG. 6 is a back perspective view of the back cover.

First, an outline construction of a tape printing apparatus according to the preferred embodiment will be described with reference to FIGS. 1 to 6. FIG. 1 is a plan view of the tape printing apparatus, FIG. 2 is a back plan view of the tape printing apparatus in which a back cover is removed therefrom, FIG. 3 is a back perspective view of the tape printing apparatus, FIG. 4 is a back perspective view of the tape printing apparatus showing a state that removing of the back cover is started, FIG. 5 is a back perspective view in a state that the back cover is removed, and FIG. 6 is a back perspective view of the back cover.

As shown in FIG. 1, the tape printing apparatus 1 has an apparatus body 2, and on a central position of the apparatus body 2, it is provided a keyboard 3 on which various keys to input characters and marks and a function key are arranged. At an upper side of the keyboard 3, a liquid crystal display 4 is arranged. At a left side of the liquid crystal display 4 a cutter lever 5 is rotatably supported.

Figure 2:
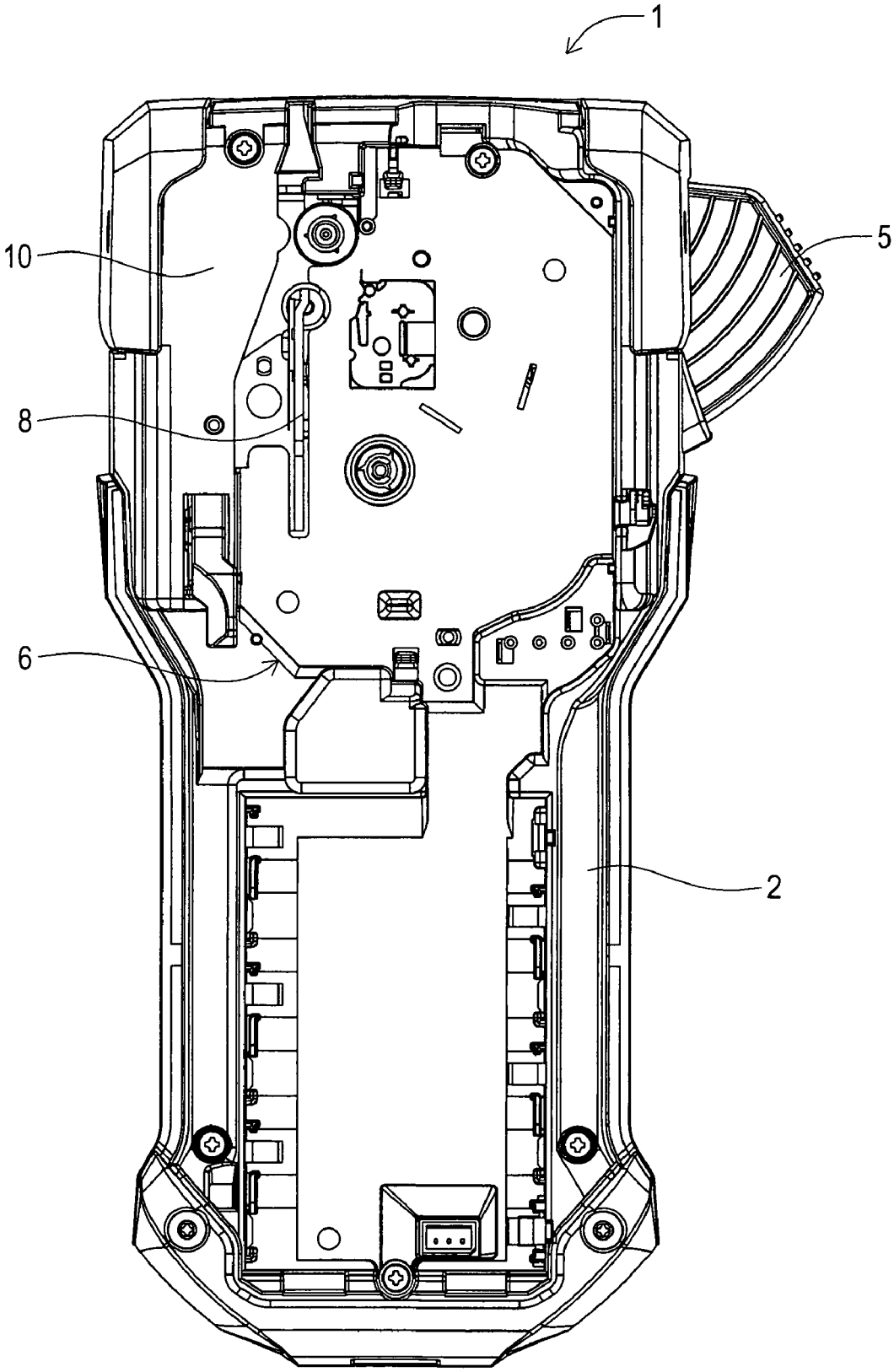
FIG. 2 is a back plan view of the tape printing apparatus in which a back cover is removed therefrom.

On a back side of the apparatus body 2, as shown in FIG. 2, a cassette installation portion 6 is provided. In the cassette installation portion 6, a tape cassette 7 is installed as shown in FIG. 5. Here, in the tape cassette 7, a tape spool around which a film tape is wound, an ink ribbon spool around which an ink ribbon is wound, a ribbon winding spool for winding an ink ribbon used in printing and an adhesive tape spool around which an adhesive tape is wound, are arranged. Construction of this kind of tape cassette 7 is well-known, thus description thereof will be omitted.

In the cassette installation portion 6, a thermal head 8 is provided so as to stand up from a floor of the cassette installation portion 6. The thermal head 8 is inserted in a head insertion portion of the tape cassette 7 (see FIG. 5). At a left side of the thermal head 8, a platen holder (not shown) for rotatably supporting a platen roller (not shown) is rotatably supported under a cover 10. When characters are printed on the film tape, a back cover 11 (see FIGS. 3, 4 and 6) is attached to a back side of the apparatus body 2, thereby the platen holder is rotated toward the thermal head 8, through a holder lever 12 (see FIG. 5) which is rotated while contacting with a covering surface of the back cover 11. Based on this, the platen roller is contacted with the thermal head 8 in a state that the film tape and the ink ribbon exist between the platen roller and the thermal head 8. In this state, based on that heat elements of the thermal head 8 are driven to be heated, characters are printed on the film tape. And when the back cover 11 is removed from the apparatus body 2, contact between the covering surface of the back cover 11 and the holder lever 12 is released, thereby the platen holder is rotated in a direction that the platen roller is separated from the thermal head 8. Therefore, the platen roller is separated from the thermal head 8.

Here, the above mentioned construction is well-known, thus description thereof will be omitted.

The film tape on which characters are printed by the thermal head 8, as mentioned in the above, is discharged from a tape discharge slot 13 (see FIG. 5) which is formed an end side of the apparatus body 2 (upper end side in FIG. 2).

The back cover 11 is a member to cover the back side of the apparatus body 2 and to protect the tape cassette 7 and a printing mechanism. As shown in FIG. 6, an engagement lib 14 is formed on a back side wall of the back cover 11. As described hereinafter, this engagement lib 14 engages with a stopper member 15 (mentioned later) when the back cover 11 is attached to the back side of the apparatus body 2. The engagement lib 14 functions so as to release an engaging state between the stopper member 15 and the cutter lever 5 and enable operation of the cutter lever 5. This function of the engagement lib 14 will be described later. And the tape discharge slot 13 is formed on a will portion 16 formed at an end portion of the back cover 11.

Figure 7:
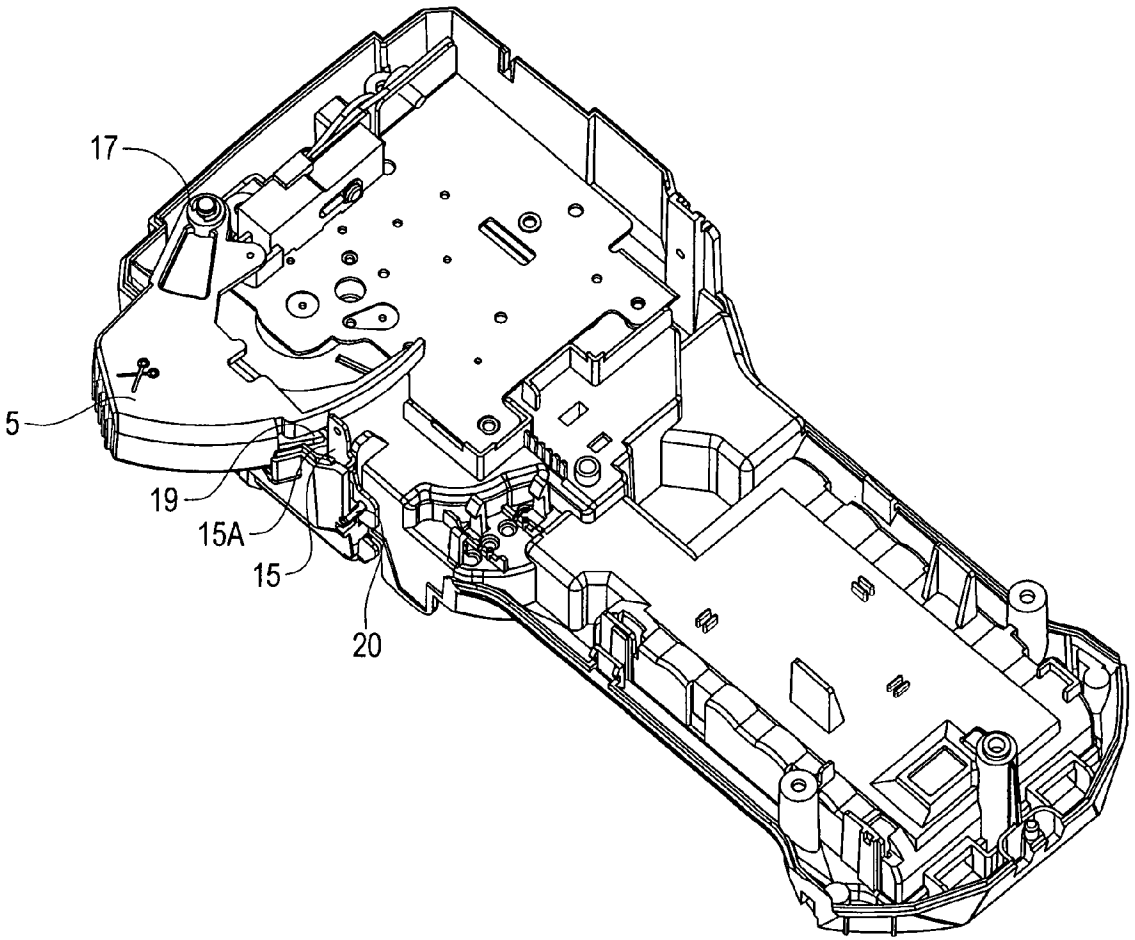
FIG. 7 is perspective view of an apparatus body in a state that an upper cover and the back cover are removed from the apparatus body.

Next, an inner construction arranged under an upper cover in the apparatus body 2 will be described with reference to FIGS. 7 and 8. FIG. 7 is perspective view of the apparatus body in a state that an upper cover and the back cover are removed from the apparatus body, and FIG. 8 is a perspective view of the apparatus body in a state that the upper cover is removed from the apparatus body and the back cover is attached to the apparatus body.

In FIG. 7, at one end of the cutter lever 5, a rotation support portion 17 is formed, and this rotation support portion 17 is pressed to a support pin 25 (see FIG. 11) which is formed at the side of the apparatus body 2. Thereby, the cutter lever 5 is rotatably supported on the apparatus body 2. And on the cutter lever 5, a difference portion 19 is formed at an opposite side of the rotation support portion 17. With the difference portion 19, an engagement portion 15A of the stopper member 15 is engaged in a state that the back cover 11 is removed from the apparatus body 2. In the state that the engagement portion 15A of the stopper member 15 is engaged with the difference portion 19, the cutter lever 5 cannot be rotated in the counter-clockwise direction, thus the cutter lever 5 becomes inoperable.

Figure 8:
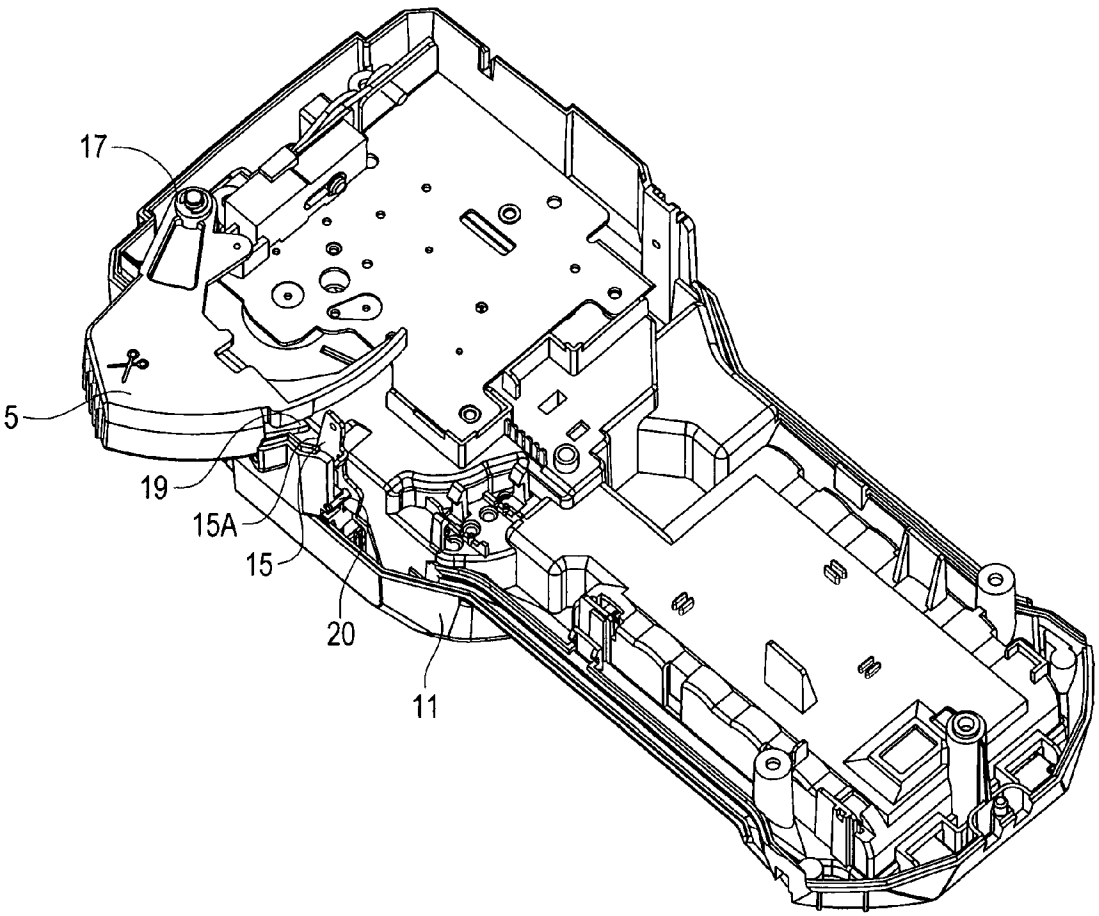
FIG. 8 is a perspective view of the apparatus body in a state that the upper cover is removed from the apparatus body and the back cover is attached to the apparatus body.

As shown in FIG. 8, in a state that the back cover 11 is attached to the apparatus body 2, as mentioned later, the engagement lib 14 of the back cover 11 is engaged with an engagement portion 15B (see FIG. 14) of the stopper member 15, thereby the stopper member 15 is rotated in the clockwise direction around a support shaft 20 which is inserted into a rotation support portion 15C (see FIG. 13) Based on rotation of the stopper member 15, the engagement portion 15A of the stopper member 15 is released from the difference portion 19 of the cutter lever 5, as a result, the cutter lever 5 becomes operable in the counter-clockwise direction around the rotation support portion 17.

Figure 9:
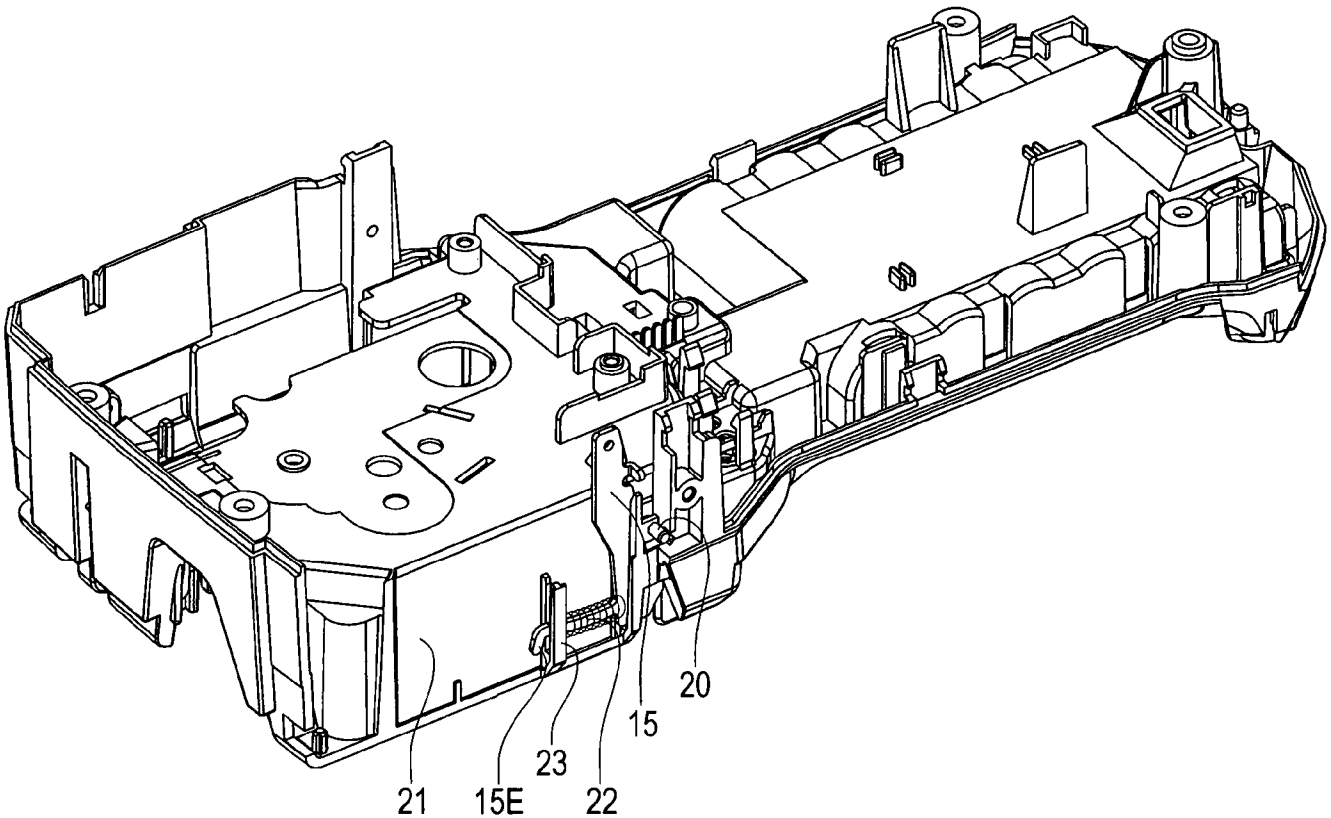
FIG. 9 is a perspective view of the apparatus body in a state that both the upper cover and the back cover are removed from the apparatus body and a part of side wall existing around a stopper member is broken.
Figure 10:
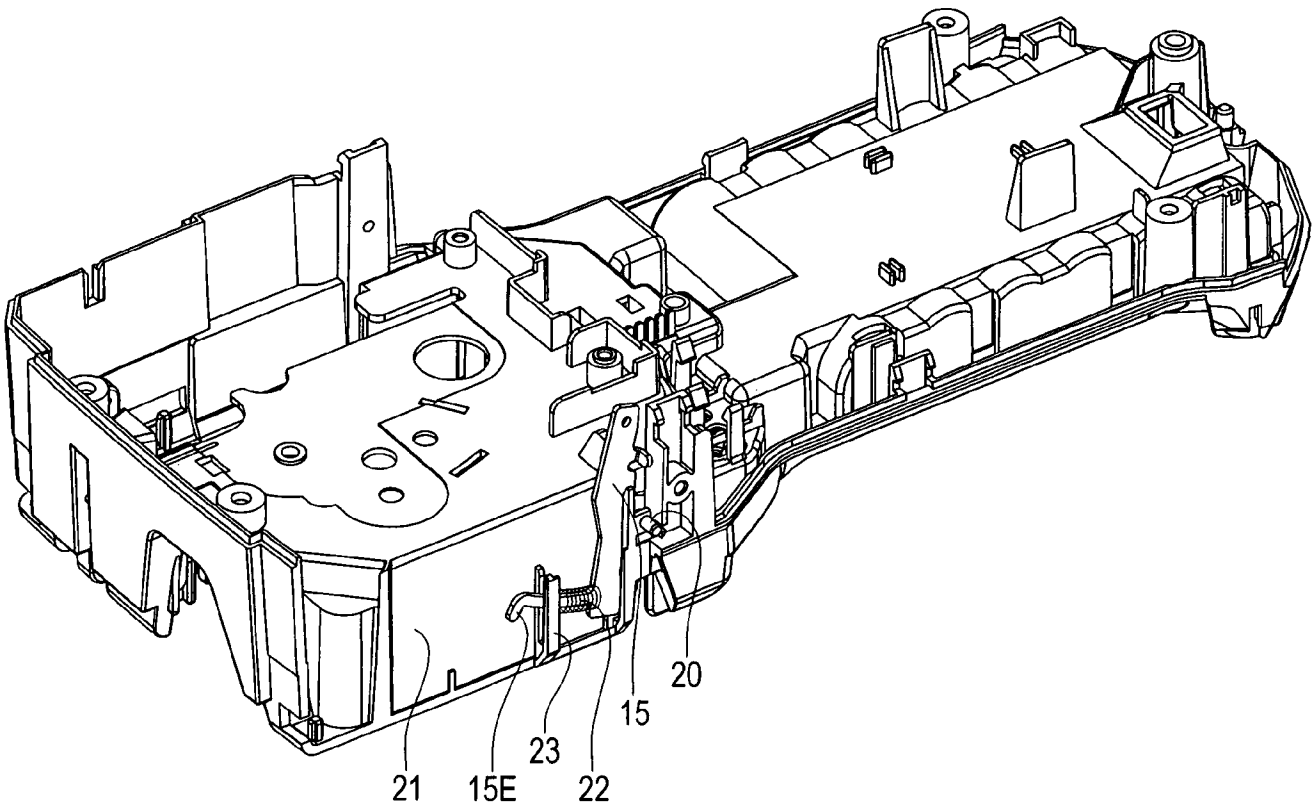
FIG. 10 is a perspective view of the apparatus body in a state that both the upper cover and the back cover are removed from the apparatus body and a part of side wall existing around a stopper member is broken.

Next, the construction of the stopper member 15 will be described with reference to FIGS. 9 and 10. FIGS. 9 and 10 are a perspective views of the apparatus body in a state that both the upper cover and the back cover are removed from the apparatus body and a part of side wall existing around a stopper member is broken. Here, in FIG. 10, although the perspective views are shown in a state that the back cover 11 is removed, explanation will be done hereinafter based on a state that the back cover 11 is attached.

The stopper member 15 is made of metal and formed in the L-shape when seen from a side surface thereof and has a support hole 15D (see FIG. 14) formed in the rotation support portion 15C. And a support hole (not shown) is formed in a wall portion 21, which forms a wall of the cassette installation portion 6 formed on the underside of the apparatus body 2 and has a parallel relation to a wall surface of the tape cassette 7 installed in the cassette installation portion 6. The support shaft 20 is inserted in both the support hole 15D formed in the stopper member 15 and the support hole formed in the wall portion 21. Thereby, the stopper member 15 is rotatably supported around the support shaft 20.

A spring support portion 15E is formed in the stopper member 15, and a coil spring member 22, which urges the stopper member 15 so as to rotate in the counter-clockwise direction, is provided around the spring support portion 15E. An end of the spring support portion 15E is engaged in a U-shaped groove of an engagement portion 23 which is formed in a forked-shape on the wall portion 21. Thereby, the stopper member 15 is usually urged in the counter-clockwise direction through urging force by the coil spring member 22.

In a case that the back cover 11 is attached to the back side of the apparatus body 2, the engagement lib 14 of the back cover 11 is contacted and engaged with the engagement portion 15B of the stopper member 15. In this state, the stopper member 15 is in a state to be rotated in the clockwise direction against the urging force of the coil spring member 22. This state is shown in FIG. 10. as mentioned, in a case that the stopper member 15 is rotated in the clockwise direction, the engagement portion 15A of the stopper member 15 is released from the difference portion 19 of the cutter lever 5, thereby the cutter lever 5 becomes rotatable and operable.

Further, when the back cover 11 is removed form the back side of the apparatus body 2, the stopper member 15 is rotated in the counter-clockwise direction by the urging force of the coil spring member 22. This state is shown in FIG. 10. As such, in a case that the stopper member 15 is rotated in the counter-clockwise direction, the engagement portion 15A of the stopper member 15 is engaged with the difference portion 19 of the cutter lever 5, thereby the cutter lever 5 cannot be rotated and becomes inoperable.

Figure 11:
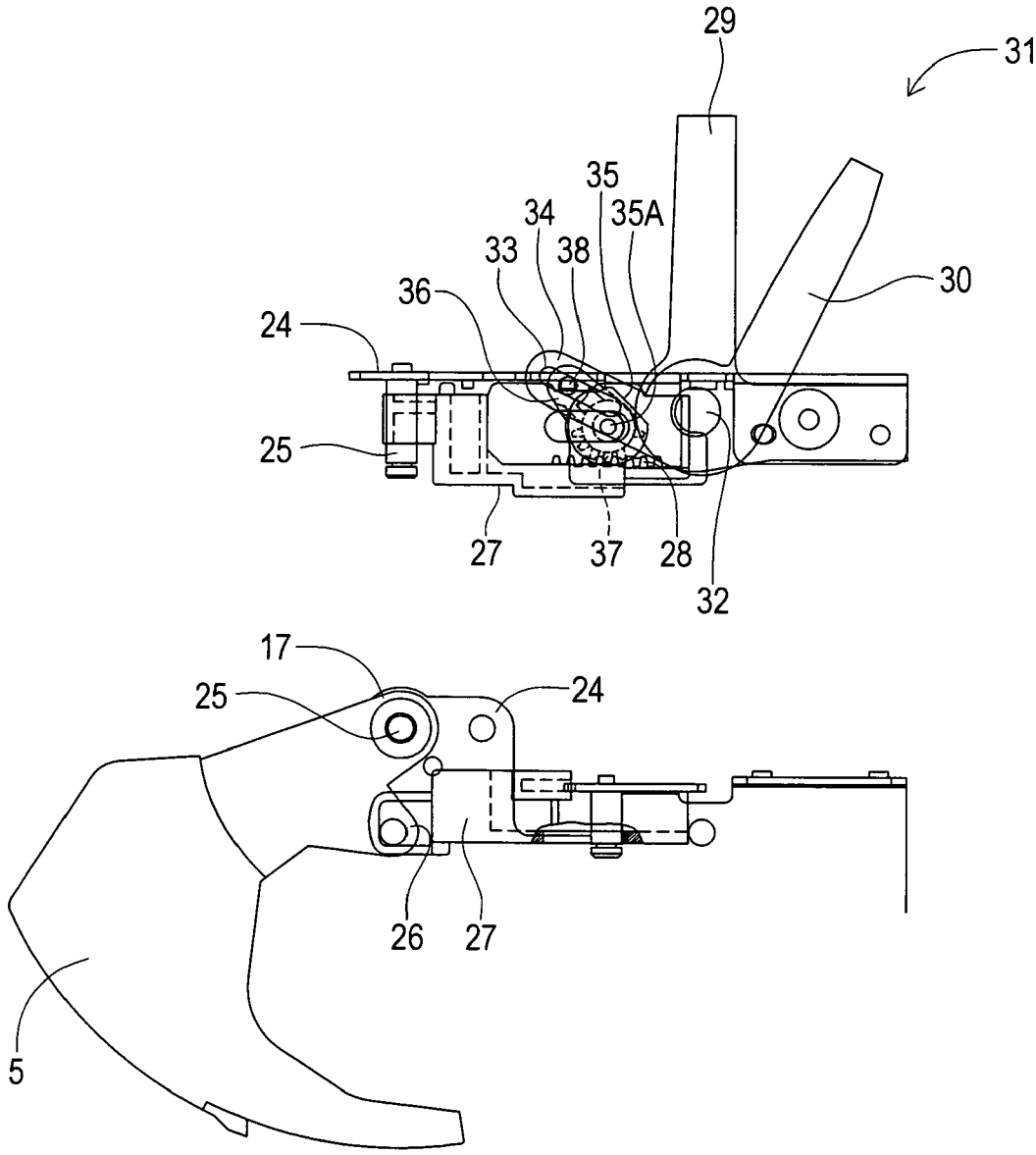
FIG. 11 is an explanatory view showing a relation between the cutter lever and the cutter in a state before the cutter is not driven.
Figure 12:
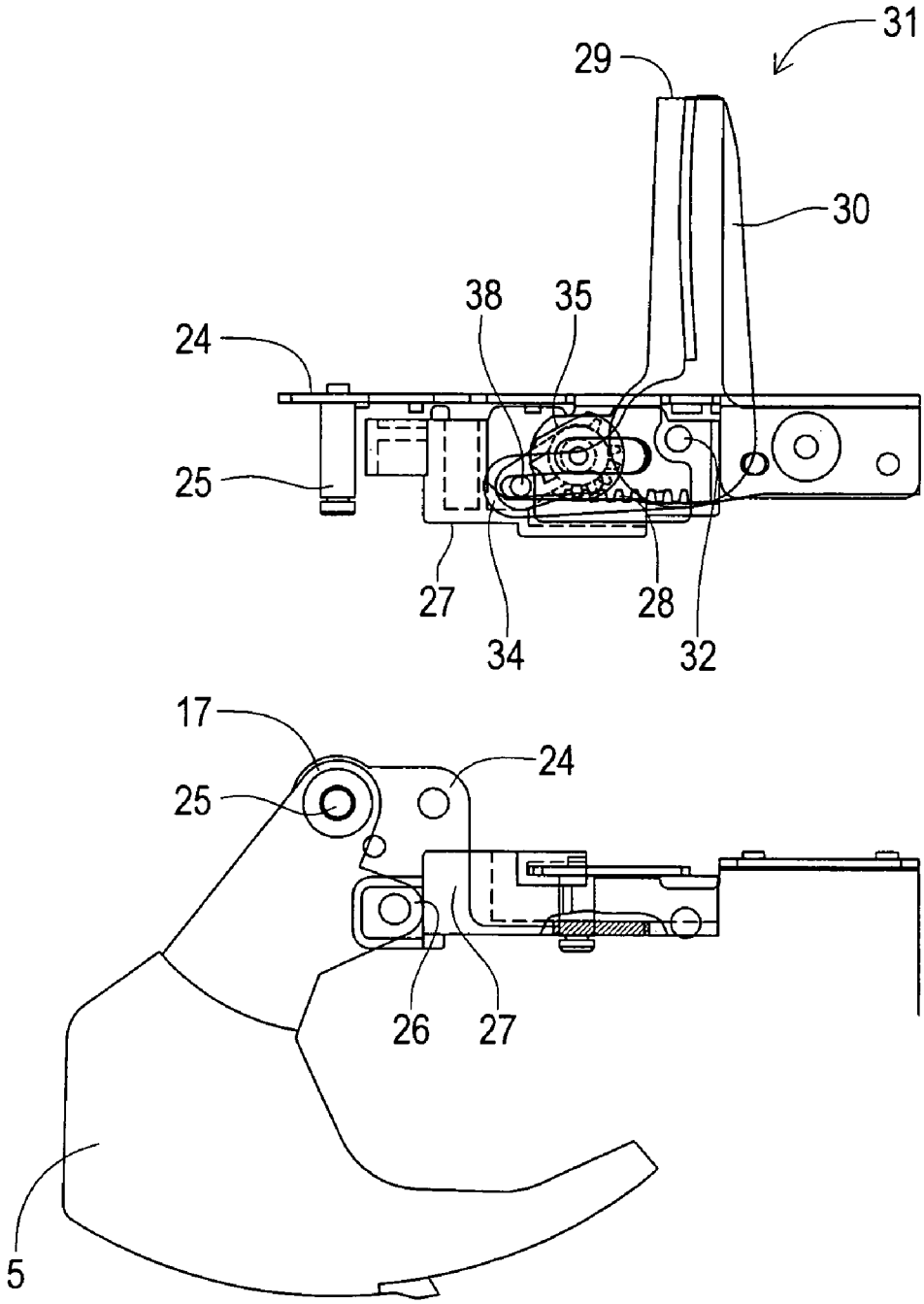
FIG. 12 is an explanatory view showing a relation between the cutter lever and the cutter in a state when the cutter is driven.

Next, the construction for driving a cutter through the cutter lever 5 will be described with reference to FIGS. 11 and 12. FIG. 11 is an explanatory view showing a relation between the cutter lever and the cutter in a state before the cutter is not driven, and FIG. 12 is an explanatory view showing a relation between the cutter lever and the cutter in a state when the cutter is driven.

In FIG. 11, a rotation support portion 17 of the cutter lever 5 is supported on a main frame 24, and the support pin 25 is protruded from the main frame 24. The support pin 25 is inserted in a pin insertion hole formed in the rotation support portion 17. And on the main frame 24, a rack gear member 27 is slidably arranged. Rack teeth 28 are formed in the rack gear member 27. Further, a scissors-like cutter 31, which is constructed from a fixed blade 29 and a movable blade 30, is disposed on the main frame 24. The fixed blade 29 is fixed on the main frame 24 through a fixing pin 32, and the movable blade 30 is arranged so as to become rotatable around the fixing pin 32.

The movable blade 30 is formed in a shape of "L" and at the opposite side of a blade portion which constructs a blade part in cooperation with the fixed blade 29 when the fixing pin 32 is set as a standard, an operation portion 34 in which a long hole 33 is formed is formed. And a shaft 35A is formed on the main frame 24 and a pinion gear member 35 is rotatably supported through the shaft 35A on the main frame 24. A pin support portion 36 is extended from the pinion gear member 35. In the pinion gear member 35, pinion teeth 37 meshing with the rack teeth 28 of the rack gear member 27 are formed, and a pin 38 inserted in the long hole 33 in the operation portion 34 of the movable blade 30 is formed in the pin support portion 36.

In the above construction, in order to cut the tape by driving the movable blade 30 of the cutter 31, the cutter lever 5 is rotated in the counter-clockwise direction from a state shown in FIG. 11. According to rotation of the cutter lever 5 in the counter-clockwise direction, the operative portion 26 moves to the right side in FIG. 11 and contacts with the end surface of the rack gear member 27. And when the cutter lever 5 is further rotated, the rack gear member 27 is moved to the right side as shown in FIG. 12, thereby the rack teeth 28 are moved to the right side. Thus, based on that the rack teeth 28 and the pinion teeth 37 of the pinion gear member 35 are meshed with each other, the pinion gear member 35 is rotated around the shaft 35A in the counter-clockwise direction. According to that the pinion gear member 35 is rotated in the counter-clockwise direction, the pin support portion 36 is also rotated in the counter-clockwise direction, thereby the pin 38 is moved to the top end direction within the long hole 33 and the movable blade 31 is rotated in the counter-clockwise direction. As a result, the fixed blade 29 and the movable blade 30 operates like the scissors and the tape is cut in cooperation with the fixed blade 29 and the movable blade 30.

Figure 13:
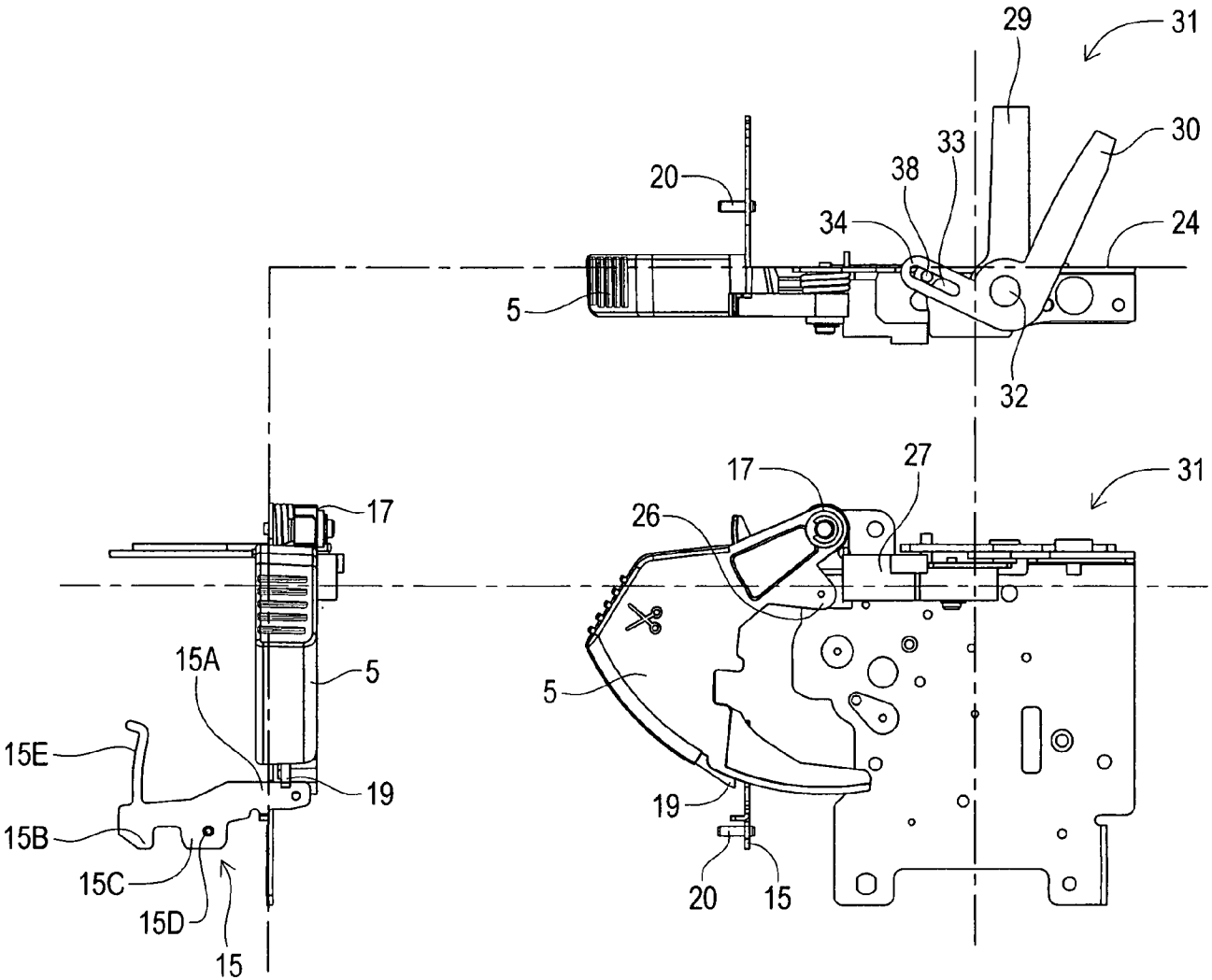
FIG. 13 is an explanatory view showing a state that the cutter lever becomes inoperable after the back cover is removed from the apparatus body.

Next, with reference to FIGS. 13 to 15, it will be described a relation between attachment and removal operation of the back cover 11 for the apparatus body 2 and operation characteristic of the cutter lever 5. FIG. 13 is an explanatory view showing a state that the cutter lever becomes inoperable after the back cover is removed from the apparatus body, FIG. 14 is an explanatory view showing a state that the cutter lever becomes operable after the back cover is attached to the apparatus body, and FIG. 15 is an explanatory view showing a state that the cutter is driven by operating the cutter lever so as to rotate, from the state shown in FIG. 14.

In FIG. 13, the back cover 11 is removed from the apparatus body 2, and in this state the engagement portion 15A of the stopper member 15 is engaged with the difference portion 19 of the cutter lever 5. Therefore, the cutter lever 5 is in the inoperable state. And the operative portion 26 of the cutter lever 5 is separated from the rack gear member 27, and in this state the fixed blade 29 and the movable blade 30 are in an opened state.

Figure 14:
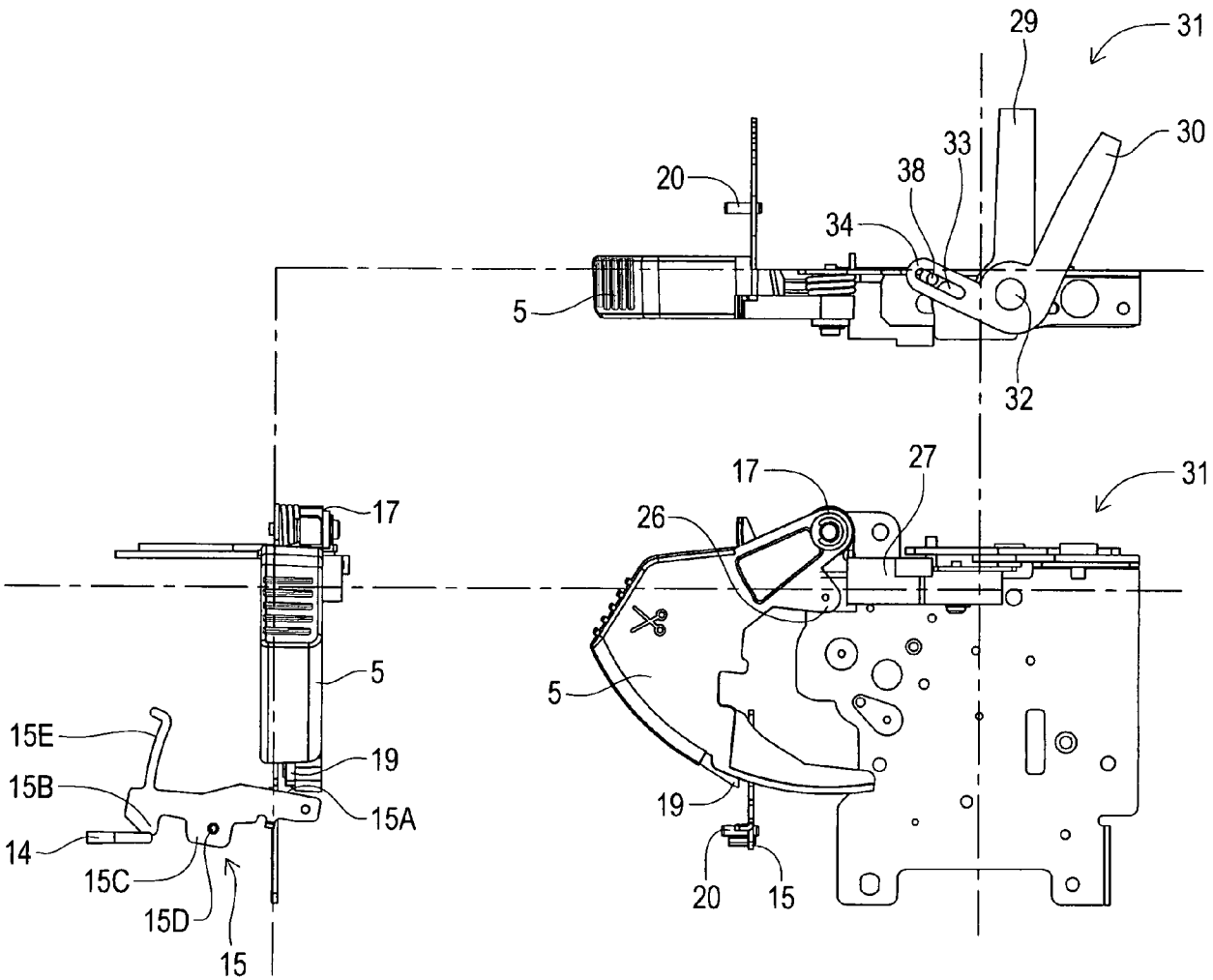
FIG. 14 is an explanatory view showing a state that the cutter lever becomes operable after the back cover is attached to the apparatus body.
Figure 15:
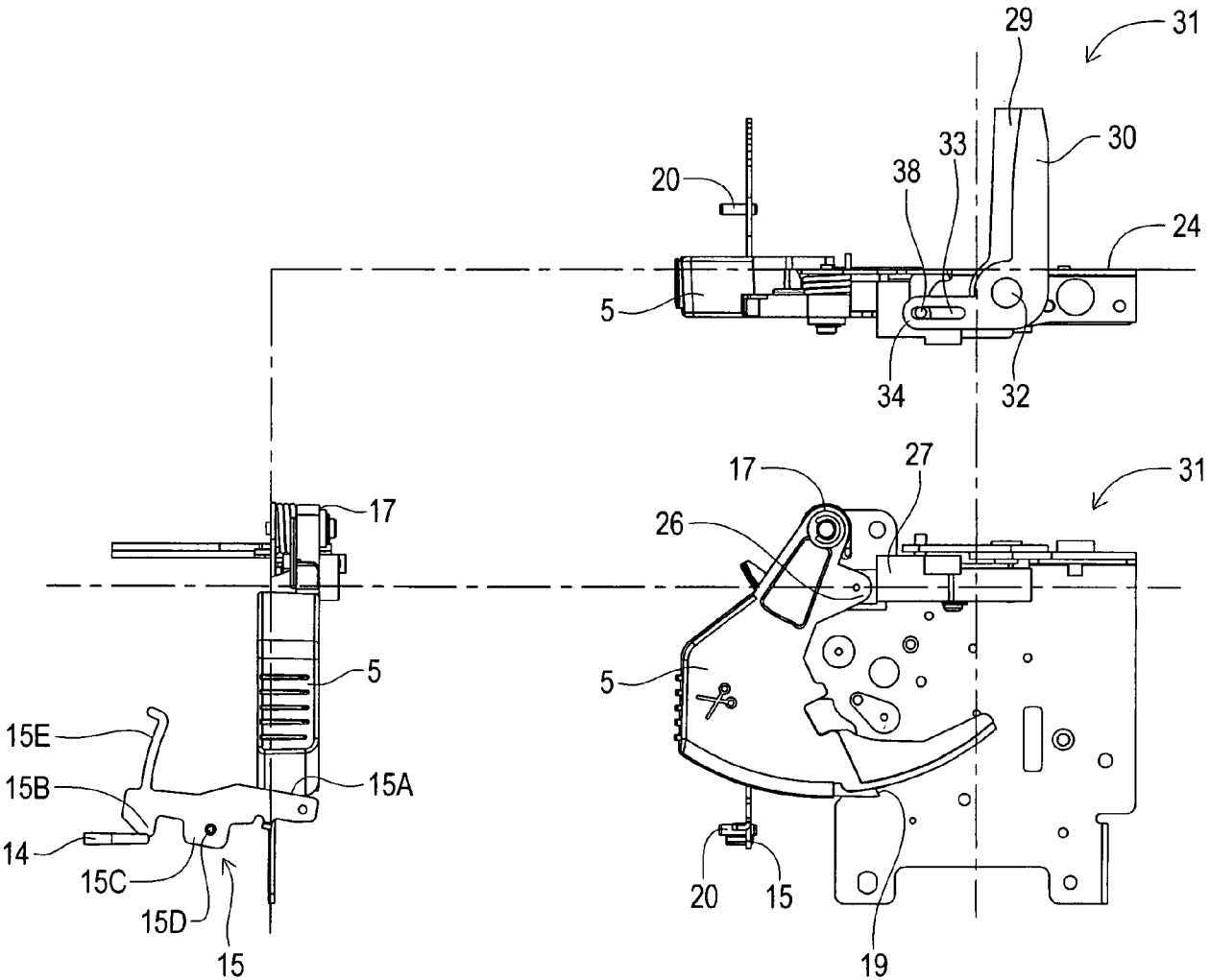
FIG. 15 is an explanatory view showing a state that the cutter is driven by operating the cutter lever so as to rotate, from the state shown in FIG. 14.

When the back cover 11 is attached to the apparatus body 2, the engagement lib 14 is engaged with the engagement portion 15B of the stopper member 15, thereby the stopper member 15 is rotated around the support shaft 20 in the clockwise direction, as shown in FIG. 14. As a result, the engagement portion 15A of the stopper member 15 is separated from the difference portion 19 of the cutter lever 5 and the cutter lever 5 becomes operable state.

Here, at this time, the operative portion 26 of the cutter lever 5 is still separated from the rack gear member 27, and the fixed blade 29 and the movable blade 30 are in the opened state.

When the cutter lever 5 is rotated in the state shown in FIG. 14, the operative portion 26 of the cutter lever 5 is going to gradually contact with the rack gear member 27. Thereby, the rack gear member 27 is moved to the right direction in FIG. 15, and the rack teeth 28 are moved to the right direction as mentioned in the above. Thereby, based on that the rack teeth 28 and the pinion teeth 37 of the pinion gear member 35 are meshed with each other, the pinion gear member 35 is rotated around the shaft 35A (see FIG. 11) in the counter-clockwise direction. According to that the pinion gear member 35 is rotated in the counter-clockwise direction as mentioned, the pin support portion 36 is also rotated in the counter-clockwise direction. Thereby, the pin 38 moves to the top end direction within the long hole 33 and the movable blade 30 is rotated in the counter-clockwise direction (see FIG. 11). As a result, the fixed blade 29 and the movable blade 30 operate like the scissors, and the tape is cut in cooperation with the fixed blade 29 and the movable blade 30.

As mentioned in the above, according to the tape printing apparatus 1 of the embodiment, in the state that the back cover 11 is not attached to the apparatus body 2, the coil spring member 22 urges the stopper member 15 so as to rotate and the cutter lever 5 becomes inoperable based on that the engagement portion 15A of the stopper member 15 is engaged with the difference portion 19 of the cutter lever 5, and in the state that the back cover 11 is attached to the apparatus body 2, the stopper member 5 is rotated against the urging force of the coil spring member 22 based on that the engagement lib 14 of the back cover 11 is engaged with the engagement portion 15B of the stopper member 15 and the cutter lever 5 becomes operable based on that the engagement portion 15A of the stopper member 15 is released from the difference portion 19 of the cutter lever 5. Therefore, even if the cutter lever 5 and the platen holder are separately arranged at each of both sides of the apparatus body 2, the cutter lever 5 can be changed between an inoperable state and an operable state by a simple construction.

And since the stopper member 15 formed in a plate form is arranged parallel to the wall surface of the tape cassette 4 installed in the cassette installation portion 6, the stopper member 15 can be arranged against the cutter lever 5 without enlarging the lateral width of the tape printing apparatus 1.

Further, in order to dispose the coil spring member 22 for the stopper member 15, since the stopper member 15 is formed in the "L" shape and the spring support portion 15E is formed in the stopper member 15 and the coil spring member 22 is disposed for the spring support portion 15E, a special member to retain the coil spring member 22 becomes unnecessary, therefore cost of the tape printing apparatus 1 can be reduced.

Here, the present invention is not limited to the embodiment, and various changes and modifications can be done within the scope of the present invention.

In the embodiment, although the back cover 11 is constructed so as to be independently attachable to and removable from the apparatus body 2, the back cover 5 may be constructed so as to be openable and closeable for the apparatus body 2 through a hinge portion formed in the back cover 11. And in the embodiment, although the engagement lib 14 is formed into one body with the back cover 11 on the back side wall of the back cover 11, a boss or pin may be used instead of the engagement lib 14, or the engagement lib 14 may be separately formed from the back cover 11. In the embodiment, although the stopper member 15 is made of metal, the stopper member 15 may be made of ceramics.

What is claimed is:

1. A tape printing apparatus comprising:

a tape printing apparatus body;

a cassette installation portion provided in the tape printing apparatus body, in the cassette installation portion a tape cassette being installed;

a print head for printing characters on a tape derived from the tape cassette;

a tape discharge portion for discharging the tape on which characters are printed through the print head;

a cutter constructed in a scissors-like shape from a fixed blade and a movable blade, the cutter being provided within the tape printing apparatus body adjacent to the tape discharge portion;

a cutter lever for driving the movable blade of the cutter, the cutter lever being rotatably arranged in the tape printing apparatus body;

a drive mechanism for transmitting rotation of the cutter lever to the movable blade, the drive mechanism being arranged between the cutter lever and the movable blade;

a cover member arranged so as to be openable and closeable for the tape printing apparatus body;

the tape printing apparatus further comprising:

a first engagement portion formed on a back surface of the cover member;

a difference portion formed in the cutter lever;

a stopper member formed in a plate-like shape, the stopper member including a second engagement portion which is rotatably formed parallel to a wall surface of the tape cassette and is engaged with the difference portion of the cutter lever, a third engagement portion engaging with the first engagement portion and a spring support portion; and a spring member supported to the spring support portion, the spring member urging the stopper member so as to rotate;

wherein when the tape printing apparatus body is not covered by the cover member, the spring member urges the stopper member so as to rotate and the second engagement portion of the stopper member is engaged with the difference portion of the cutter lever, thereby the cutter lever becomes inoperable, and wherein when the tape printing apparatus body is covered by the cover member, the stopper member is rotated against rotational urging force of the spring member based on that the first engagement portion of the cover member is engaged with the third engagement portion of the stopper member and the second engagement portion of the stopper member is released from the difference portion of the cutter lever, thereby the cutter lever becomes operable.

2. The tape printing apparatus according to claim 1, wherein the stopper member is formed from a L-shaped member when seen from a side surface thereof and the spring support portion is formed from a part of the L-shaped member.

3. The tape printing apparatus according to claim 2, wherein the spring member is formed from a coil spring member arranged around an outer side of spring support portion.

4. The tape printing apparatus according to claim 1, wherein the drive mechanism comprises:

a rack gear member slidably provided on a frame, the rack gear member having rack teeth thereon;

an operation portion formed into one body with the movable blade at a position opposite to a blade portion in the movable blade, in the operation portion a long hole being formed;

a pinion gear member rotatably supported in the frame, in the pinion gear member pinion teeth meshing with the rack teeth of the rack gear member being formed and a pin inserted within the long hole of the operation portion being formed;

wherein when the cutter lever is rotated, the pinion gear member is rotated through the pinion teeth meshing with the rack teeth based on that the rack gear member is contacted with the cutter lever and slid on the frame, and the pin is moved toward an end direction within the long hole, thereby the movable blade is moved toward the fixed blade.

* * * * *